US010571079B1

(12) United States Patent
Yang

(10) Patent No.: US 10,571,079 B1
(45) Date of Patent: Feb. 25, 2020

(54) LINEAR LED LIGHT WITH SUSPENDLY MOUNTED FILAMENT

(71) Applicant: Nathan Yang, Surrey (CA)

(72) Inventor: Nathan Yang, Surrey (CA)

( * ) Notice: Subject to any disclaimer, the term of this patent is extended or adjusted under 35 U.S.C. 154(b) by 0 days.

(21) Appl. No.: 16/511,977

(22) Filed: Jul. 15, 2019

(51) Int. Cl.
*F21K 9/272* (2016.01)
*F21K 9/275* (2016.01)
*F21Y 115/10* (2016.01)

(52) U.S. Cl.
CPC ..... *F21K 9/272* (2016.08); *F21K 9/275* (2016.08); *F21Y 2115/10* (2016.08)

(58) Field of Classification Search
CPC ..... F21K 9/272; F21K 9/275
USPC ..... 362/217.01
See application file for complete search history.

(56) References Cited

U.S. PATENT DOCUMENTS

2009/0016806 A1* 1/2009 Wolf ..... G09F 9/33 403/24
2012/0212951 A1* 8/2012 Lai ..... F21V 23/002 362/218
2013/0241443 A1* 9/2013 Ozguc ..... F21V 23/04 315/362
2014/0009925 A1* 1/2014 Verhoeven ..... F21V 19/008 362/221
2015/0146418 A1* 5/2015 Lin ..... H01R 33/0836 362/217.13
2015/0176771 A1* 6/2015 Lin ..... H01R 33/08 439/226
2015/0198291 A1* 7/2015 Lin ..... F21K 9/27 362/217.13
2016/0178135 A1* 6/2016 Xu ..... F21V 25/04 362/223
2016/0219666 A1* 7/2016 Xiong ..... H05B 33/0815
2016/0219672 A1* 7/2016 Liu ..... F21K 9/27
2016/0327216 A1* 11/2016 Gielen ..... F21K 9/27
2017/0196064 A1* 7/2017 Xiong ..... H05B 33/089

* cited by examiner

*Primary Examiner* — Bryon T Gyllstrom
(74) *Attorney, Agent, or Firm* — Gulf Coast Intellectual Property Group

(57) ABSTRACT

A LED light assembly that utilizes an LED filament wherein the LED filament is suspendedly mounted within the interior volume of the linear lamp tube of the present invention. The LED light assembly includes end caps configured to be operably secured to opposing ends of the lamp tube. A pair of connection members are configured to be operably coupled with the pair of end caps. The connection members are manufactured from electrically conductive material and are operably coupled to electrical supply wires. A pair of mounting members are operably coupled to each connection member are include a coil suspension member that has a first hook and a second hook formed on opposing ends thereof. The LED filament is operably coupled intermediate the pair of mounting members.

20 Claims, 2 Drawing Sheets

LINEAR LED LIGHT WITH SUSPENDLY MOUNTED FILAMENT

FIELD OF THE INVENTION

The present invention relates generally to lighting apparatus, more specifically but not by way of limitation, a linear led light that utilizes a glass lamp such as but not limited to a T5 glass lamp tube wherein led light filament is suspendedly mounted within the glass lamp tube.

BACKGROUND

As is known in the art, led filament type design light bulbs were developed over a decade ago and were intended to mimic the appearance of a traditional light bulbs. LED filaments consist of multiple series connected on a transparent substrate that are commonly made from glass or sapphire materials. It is desirable to utilize a transparent substrate in order to allow the light to disperse evenly without interference. During construction of LED filaments it is common to utilize a coating of yellow phosphor in a silicon resin binder to provide conversion of the blue light generated by the LED into a white light that is similar to that produced by an incandescent bulb.

A benefit of the filament design is the ability to drive improved efficiency due to the use of more LED emitters with lower current requirements. Additionally, filament style bulbs will typically provide a wider light beam range, which can be desirable for many applications. A nearly three hundred and sixty degree light beam pattern can be obtained from utilizing LED filaments. Conventional fluorescent light bulbs and fixtures have been used in the past and are currently installed where light beam patterns of broader ranges and lengths are desired. This can include but is not limited to under-counter lights and workshop lighting. Conventional fluorescent lights are less efficient and are commonly available in sizes such as but not limited to T5. LED lights are being manufactured to be installed in existing fixtures and replace conventional bulbs such as but not limited to incandescent and fluorescent bulbs. A filament style LED mounted in a glass tube is one technique to replace conventional fluorescent style bulbs.

Accordingly, there is a need for a linear led filament mounting system wherein a led filament can be suspendedly mounted in a glass tube so as to be mounted in a conventional fluorescent light fixture.

SUMMARY OF THE INVENTION

It is the object of the present invention to provide a linear LED filament mounting technique operable to provide mounting of a LED filament in a linear glass lamp tube in order to provide replacement of conventional fluorescent bulbs in existing fluorescent fixtures.

Another object of the present invention is to provide a linear LED light wherein the LED light includes a filament suspendedly mounted intermediate the first end and second end of the glass tube of the LED light.

A further object of the present invention is to provide a linear LED filament mounting technique operable to provide mounting of a LED filament in a linear glass lamp tube wherein the glass tube includes end caps at each end thereof.

Still another object of the present invention is to provide a linear LED light wherein the LED light includes a filament suspendedly mounted therein that further includes power connectors wherein the power connectors are operably coupled to the end caps.

An additional object of the present invention is to provide a linear LED filament mounting technique operable to provide mounting of a LED filament in a linear glass lamp tube wherein the power connectors are manufactured from a conductive material.

Yet a further object of the present invention is to provide a linear LED light wherein the LED light includes a filament suspendedly mounted therein that further includes a pair of mounting springs wherein the mounting springs are operably coupled to the power connectors.

Another object of the present invention is to a provide a linear LED filament mounting technique operable to provide mounting of a LED filament in a linear glass lamp tube wherein the mounting springs are manufactured of a conductive material.

An alternate object of the present invention is to provide a linear LED light wherein the LED light includes a filament suspendedly mounted therein wherein the LED filament is suspendedly mounted intermediate the mounting springs within the glass lamp tube.

Still a further object of the present invention is to provide a linear LED filament mounting technique operable to provide mounting of a LED filament in a linear glass lamp tube wherein the present invention further provides alternate wiring techniques.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
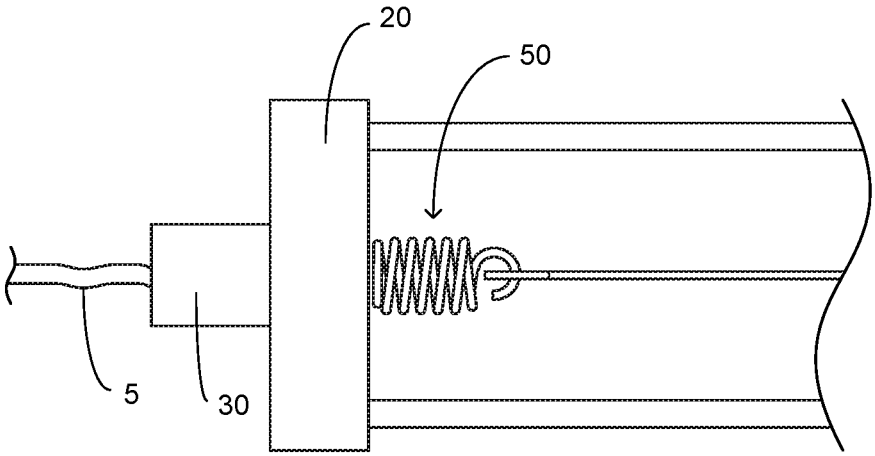
FIG. 1 is detailed view of an end of the light of the present invention.
Figure 2:
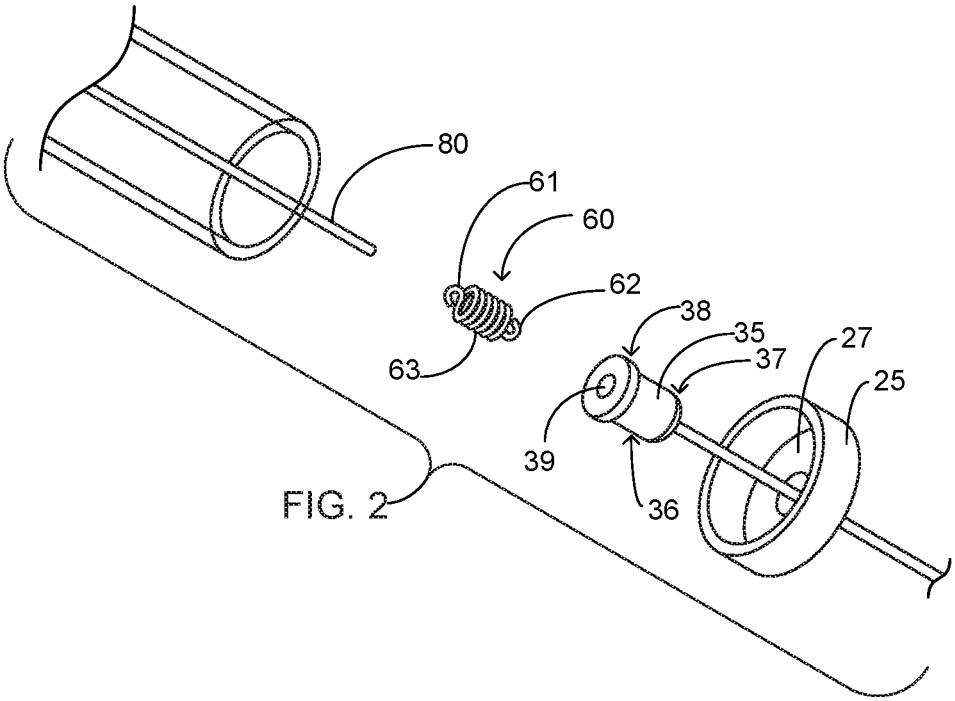
FIG. 2 is a detailed view of the mounting components of the present invention.
Figure 3:
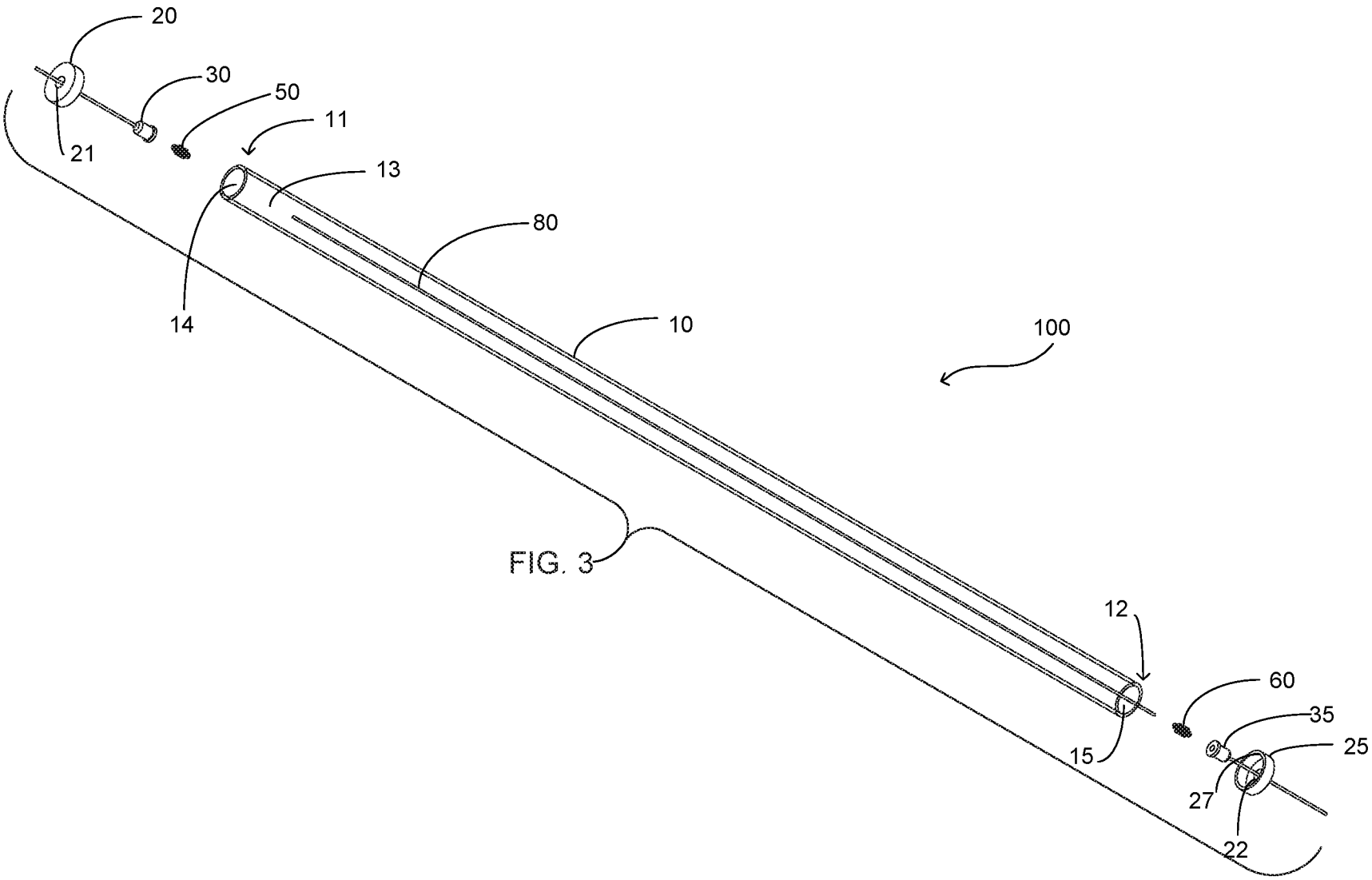
FIG. 3 is a perspective view of a disassembled embodiment of the present invention.

Referring now to the drawings submitted herewith, wherein various elements depicted therein are not necessarily drawn to scale and wherein through the views and figures like elements are referenced with identical reference numerals, there is illustrated led linear light 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the led linear light 100 includes a lamp tube 10 that is cylindrical in shape and manufactured from glass. The lamp tube 10 includes a first end 11 and second end 12. The lamp tube 10 includes a hollow interior volume 13 and has openings 14,15 located at the first end 11 and second end respectively. It should be understood within the scope of the present invention that the lamp tube 10 could be manufactured in various lengths and diameters in order to be mounted into a desired fixture. Furthermore, while the lamp tube 10 is illustrated herein as being cylindrical in shape, it is contemplated within the scope of the present invention that the lamp tube 10 could be manufactured in alternate shapes.

Operably coupled to the openings 14, 15 of the lamp tube 10 are the first end cap 20 and second end cap 25. The first end cap 20 and second end cap 25 are manufactured to be mateably shaped so as to securely couple to the first end 11 and second end 12. The first end cap 20 and second end cap 25 are manufactured from a suitable material such as but not limited to plastic. The first end cap 20 and second end cap 25 include apertures 21, 22 respectively. The apertures 21,22 are formed to allow wire 5 to be journaled therethrough. While not illustrated herein, it is contemplated within the scope of the present invention that the led linear light 100 could employ an alternate wiring technique in addition to the wiring technique illustrated herein. In the alternate wiring technique both the supply and return electrical wire would ingress/egress through the same end cap. In the aforementioned alternate technique only one end cap for the led linear light 100 would have an aperture and the opposing end cap would not have an aperture.

The led linear light 100 further includes a first power connector 30 and a second power connector 35. The first power connector 30 and second power connector 35 are manufactured from a conductive material such as but not limited to metal. The wire 5 is operably coupled to the first power connector 30 and second power connector 35 utilizing suitable techniques such as but not limited to soldering. The first power connector 30 and second power connector 35 are identically constructed and as such a detail of the second power connector 35 following applies to the first power connector 30. The second power connector 35 includes a body 36 that is cylindrical in shape and of suitable size to be journaled into aperture 22. The body 36 includes first end 37 and second end 38. A passage 39 extends through the body 36 intermediate first end 37 and second end 38. Formed on the second end 38 of the body 36 is lip member 40. Lip member 40 is integrally formed with body 36 and is operable to inhibit the passage of the second power connector 35 completely through aperture 22 ensuing the operably coupling of the second power connector 35 to the second end cap 25. The lip member 40 has a diameter that is larger than that of the aperture 22 and once coupled the lip member 40 is secured adjacent to the interior surface 27 of the second end cap 25.

The led linear light 100 further includes a first mounting member 50 and a second mounting member 60 operably coupled to the first power connector 30 and second power connector 35 respectively. The first mounting member 50 and second mounting member 60 are manufactured from a conductive material such as but not limited to metal. The first mounting member 50 and second mounting member 60 are configured to suspendedly mount the LED filament 80 within the lamp tube 10 wherein the LED filament 80 is operably coupled therebetween. The second mounting member 60 includes a first hook member 61 and a second hook member 62 having suspension member 63 intermediate thereto and integrally formed therewith. The first hook member 61 is operably coupled to LED filament 80 utilizing suitable durable techniques. The second hook member 62 is configured to be operably coupled with the second power connector 35. As both the second power connector 35 and second mounting member 60 are manufactured from conductive materials, this permits the flow of electrical current therethrough in order to provide to the LED filament 80 for operation thereof. The suspension member 63 is configured to absorb vibrations and in its preferred embodiment is manufactured as a coil spring. While a coil spring is illustrated herein for suspension member 63, it is contemplated within the scope of the present invention that the suspension member 63 could be manufactured in alternate configurations and achieve the desired objective.

It should be understood within the scope of the present invention that the first mounting member 50 is manufactured identically as the second mounting member 60 and as such the detailed description herein of the second mounting member 60 applies to the first mounting member 50. Furthermore, the LED filament 80 is a conventional LED filament and is electrically coupled intermediate the first mounting member 50 and second mounting member 60 and is suspended within the interior volume 13 of the lamp tube 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A LED light comprising:

a lamp tube, said lamp tube being elongated in manner, said lamp tube having a first end and a second end, said lamp tube having a hollow interior volume, said lamp tube having a first opening and a second opening;

a first end cap, said first end cap operably coupled to said first end of said lamp tube;

a second end cap, said second end cap operably coupled to said second end of said lamp tube;

a pair of connection members, said pair of connection members opposedly located at said first end and said second end of said lamp tube, said pair of connection members manufactured from an electrically conductive material;

a pair of mounting members, said pair of mounting members opposedly located at said first end and said second end of said lamp tube, said pair of mounting members being operably coupled to said pair of connection members, said pair of mounting members further including a suspension section; and wherein the pair of mounting members have a LED filament operably coupled therebetween and are operable to suspendedly mount the LED filament within the interior volume of said lamp tube.

2. The LED light as recited in claim 1, wherein said pair of connection members further includes a body, said body of said pair of connection members having a first end and a second end, said body of said pair of connection members having a passage extending intermediate said first end and said second end of said body of said pair of connection members.

3. The LED light as recited in claim 2, wherein said pair of mounting members further include a first hook member and a second hook member, said first hook member and said second hook member being opposedly located on said suspension section.

4. The LED light as recited in claim 3, wherein said first hook member of said pair of mounting members is operably coupled with the hollow passage of each of said pair of connection members.

5. The LED light as recited in claim 4, wherein said pair of connection members further include a lip member, said lip member configured to engage the first end cap member and second end cap member.

6. The LED light as recited in claim 5, wherein said suspension section is manufactured as a coil spring.

7. A linear LED light having a suspendedly secured LED filament therein comprising:

a lamp tube, said lamp tube being elongated in manner, said lamp tube having a first end and a second end, said lamp tube having a hollow interior volume, said lamp tube having a first opening and a second opening;

a first end cap, said first end cap mateably shaped with said lamp tube, said first end cap operably coupled to said first end of said lamp tube;

a second end cap, said second end cap mateably shaped with said lamp tube, said second end cap operably coupled to said second end of said lamp tube;

a first connection member, said first connection member being proximate said first end of said lamp tube, said first connection member being manufactured from an electrically conductive material, said first connection member being operably coupled with said first end cap;

a second connection member, said second connection member being proximate said second end of said lamp tube, said second connection member being manufactured from an electrically conductive material, said second connection member being operably coupled with said second end cap;

a first mounting member, said first mounting member being operably coupled with said first connection member opposite said first end cap, said first mounting member being manufactured from a electrically conductive material, said first mounting member having a first end and a second end, said first mounting member having a suspension member intermediate said first end and said second end of said first mounting member;

a second mounting member, said second mounting member being operably coupled with said second connection member opposite said second end cap, said second mounting member being manufactured from a electrically conductive material, said second mounting member having a first end and a second end, said second mounting member having a suspension member intermediate said first end and said second end of said second mounting member; and wherein an LED filament is suspendedly mounted within the interior volume of said lamp tube intermediate said first mounting member and said second mounting member.

8. The linear LED light as recited in claim 7, wherein said first connection member further includes a lip member, said lip member configured to engage an interior surface of said first end cap during operable coupling thereof.

9. The linear LED light as recited in claim 8, wherein said second connection member further includes a lip member, said lip member of said second connection member configured to engage an interior surface of said second end cap during operable coupling thereof.

10. The linear LED light as recited in claim 9, wherein the first mounting member includes a first hook member proximate said first end thereof and a second hook member proximate the second end thereof.

11. The linear LED light as recited in claim 10, wherein the second mounting member includes a first hook member proximate said first end thereof and a second hook member proximate the second end thereof.

12. The linear LED light as recited in claim 11, wherein said first connection member further includes a hollow passage extending therethrough.

13. The linear LED light as recited in claim 12, wherein said second connection member includes a hollow passage extending therethrough.

14. The linear LED light as recited in claim 12, wherein said suspension member of said first mounting member and said second mounting member is manufactured from a coil spring.

15. The linear LED light as recited in claim 14, wherein the lamp tube is elongated in manner and cylindrical in shape.

16. A linear LED light having a LED filament wherein the LED filament is suspendedly mounted comprising:

a lamp tube, said lamp tube being elongated in manner, said lamp tube having a first end and a second end, said lamp tube having a hollow interior volume, said lamp tube having a first opening and a second opening;

a first end cap, said first end cap having an interior surface, said first end cap further including an aperture, said first end cap mateably shaped with said lamp tube, said first end cap operably coupled to said first end of said lamp tube;

a second end cap, said second end cap having an interior surface, said second end cap further including an aperture, said second end cap mateably shaped with said lamp tube, said second end cap operably coupled to said second end of said lamp tube;

a first connection member, said first connection member having a first end and a second end, said first connection member further including a passage intermediate said first end and said second end of said first connection member, said first connection member being proximate said first end of said lamp tube, said first connection member being manufactured from an electrically conductive material, said first connection member being operably coupled with said first end cap;

a second connection member, said second connection member being proximate said second end of said lamp tube, said second connection member having a first end and a second end, said second connection member further including a passage intermediate said first end and said second end of said second connection member, said second connection member being manufactured from an electrically conductive material, said second connection member being operably coupled with said second end cap;

a first mounting member, said first mounting member being operably coupled with said first connection member opposite said first end cap, said first mounting member being manufactured from a electrically conductive material, said first mounting member having a coil spring, said coil spring of said first mounting member having a first end and a second end;

a second mounting member, said second mounting member being operably coupled with said second connection member opposite said second end cap, said second mounting member being manufactured from a electrically conductive material, said second mounting member having a coil spring, said coil spring of said second mounting member having a first end and a second end; and wherein a LED filament is suspendedly mounted within the interior volume of said lamp tube intermediate said first mounting member and said second mounting member.

17. The linear LED light as recited in claim 16, wherein said first end and said second end of said coil spring of said first mounting member further include a hook member formed thereon.

18. The linear LED light as recited in claim 17, wherein said first end and said second end of said coil spring of said second mounting member further include a hook member formed thereon.

19. The linear LED light as recited in claim 18, wherein said second connection member further includes a lip member being formed on the second end of said second connection member, said lip member of said second connection member configured to engage the interior surface of said second end cap ensuing being journaled through the aperture of said second end cap.

20. The linear LED light as recited in claim 19, wherein said first connection member further includes a lip member being formed on the second end of said first connection member, said lip member of said first connection member configured to engage the interior surface of said first end cap ensuing being journaled through the aperture of said first end cap.

* * * * *